United States Patent [19]

Blasnik

[11] 4,025,000

[45] May 24, 1977

[54] SPRAY NOZZLE

[75] Inventor: William Blasnik, Demarest, N.J.

[73] Assignee: Lafayette Brass Company Inc., New York, N.Y.

[22] Filed: Feb. 19, 1976

[21] Appl. No.: 659,502

[52] U.S. Cl. ..... 239/459; 239/541; 239/583

[51] Int. Cl.[2] ..... B05B 1/32

[58] Field of Search ..... 239/456, 459, 525, 526, 239/541, 583, 596, 600

[56] References Cited

UNITED STATES PATENTS

| | | | |
|---|---|---|---|
| 2,991,945 | 7/1961 | Rosenkranz | 239/459 |
| 3,001,723 | 9/1961 | Bounos | 239/459 X |
| 3,448,929 | 6/1969 | Strahman et al. | 239/459 X |

*Primary Examiner*—John J. Love

[57] ABSTRACT

A spray nozzle having an orifice plate fixedly retained in the front opening of a nozzle body by a readily deformable lip and having an improved valve stem and guide construction whereby assembly and construction of the nozzle is greatly expedited and at reduced costs.

10 Claims, 6 Drawing Figures

30A
30
10
29
30A
6
33
20B
13B
28
11A
13
23B
18
27
16A
13A
21A
17
16
21
20
26
21B
6
27
34
23
15
14
19
30
31
33A
11
11B
12

13
18
21A
16A 13
18
13A
14

26
25
23B
24

4
29
20
20A
24
23
26
25
21
21B
21A
20B
22
23A
23B
4

SPRAY NOZZLE

PROBLEM AND PRIOR ART

Heretofore many efforts have been made to simplify and reduce cost of a water spray nozzle of the type commonly used with garden hoses and the like. Such nozzles generally comprised a nozzle body having a discharge orifice and an associated valving means. The components of the valving means, e.g., the valve stem, have heretofore been formed of solid brass material. Also, the orifice plate was secured to the nozzle body by various complex means. For these reasons, such nozzle while relatively inexpensive, nevertheless were relatively costly to fabricate.

OBJECTS

An object of this invention is to provide a spray nozzle which is relatively inexpensive to fabricate and which is positive in operation.

Another object is to provide a spray nozzle construction in which the cost of production can be substantially reduced.

Another object is to provide a spray nozzle having improved means for securing the orifice plate to the nozzle body.

BRIEF SUMMARY OF THE INVENTION

The foregoing objects and other features and advantages are attained by a nozzle construction which comprises a nozzle body in which the orifice plate is retained in place by means of a readily deformable lip which is integrally formed from the material of the nozzle body. The present invention further contemplates an improved valve stem construction which comprises a plunger body having connected thereto a relative small diameter plunger stem for valving the orifice and which small diameter stem is circumscribed by a guide member formed of a relatively inexpensive material such as plastic. The arrangement or construction of the nozzle is such that the rigidity and strength of the valving stem is maintained while utilizing materials that are different in kind and which results in a simplified construction.

FEATURES

A feature of this invention resides in the provision of a spray nozzle construction in which the orifice plate is swaged in place within the nozzle body.

Another feature resides in an improved guide construction for the valve stem or plunger wherein a minimum of metal is required.

Another feature resides in the provision wherein the costs of the overall nozzle construction can be substantially reduced.

Another feature resides in the provision wherein the guide construction is such that the connection between the plunger body and plunger stem can be positively controlled so as to maintain the overall length of the valving means uniform during assembly.

Other features and advantages will become more readily apparent when considered in view of the drawings and specification in which.

Figures 1, 2, 3, 4, 5, 6:
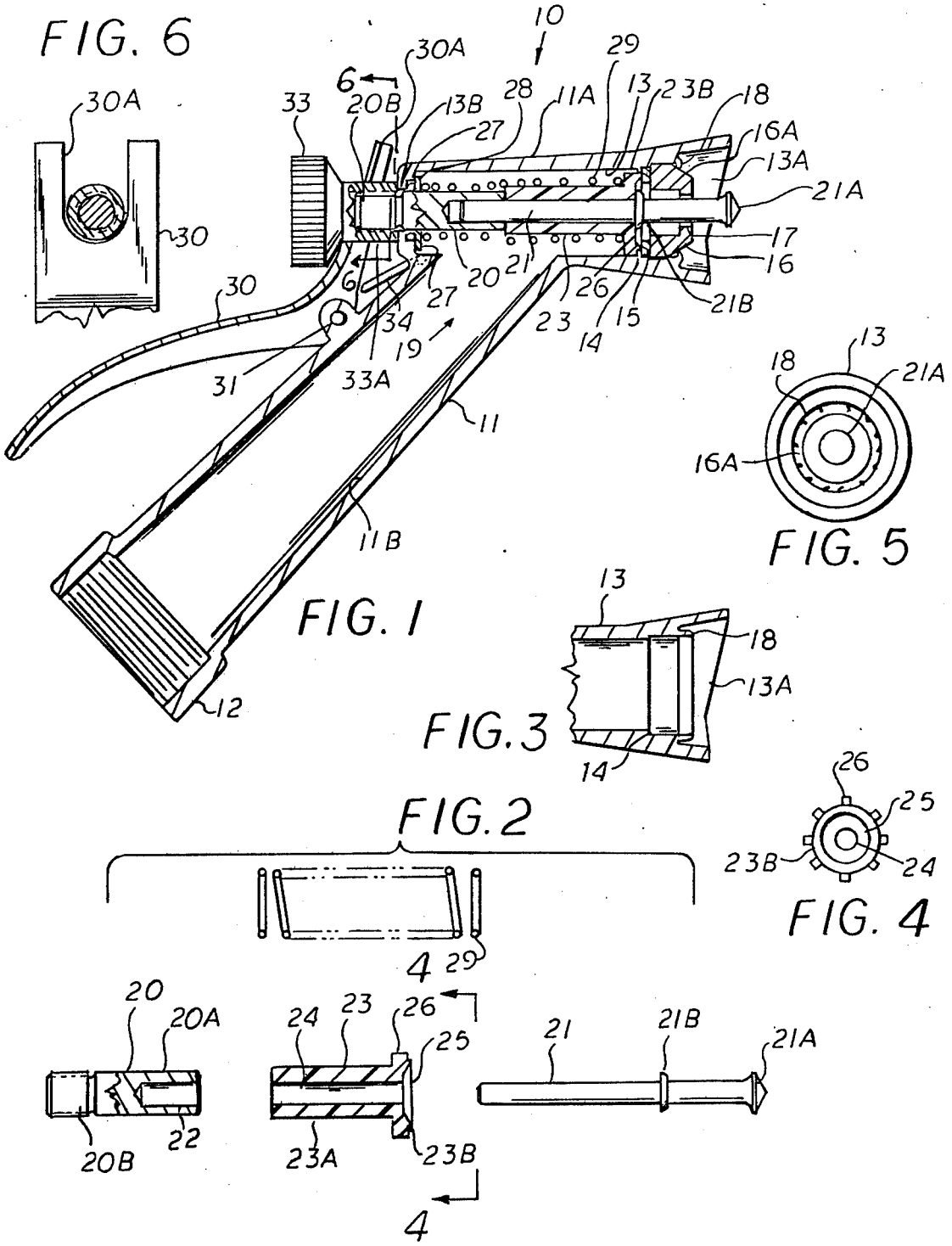
FIG. 1 is a sectional side view of a nozzle assembly embodying the present invention.
FIG. 2 is a detail exploded view of the plunger body and plunger stem assembly which defines the valving means.
FIG. 3 is a fragmentary detail sectional view of the front end of the nozzle body with the orifice plate and valve means not shown.
FIG. 4 is a front end view taken along the 4—4 on FIG. 3.
FIG. 5 is a front end view of the nozzle assembly of FIG. 1.
FIG. 6 is a sectional view taken along line 6—6 on Fig. 1.

Referring to the drawings there is shown in FIG. 1 an assembly of a spray nozzle 10 embodying the present invention. The illustrated embodiment is particularly adapted for use on the end of a garden hose. As best seen in FIG. 1, the spray nozzle 10 comprises a nozzle body 11 which includes a head portion 11A and a connected neck portion 11B. The lower end of the neck portion 11B is provided with an internal threaded female connector 12 which is adapted to receive the threaded male connector of the garden hose.

The head portion 11A of the spray nozzle 10 has an internal bore 13 extending therethrough and which terminates in a front opening 13A and a rear opening 13B. As shown adjacent the front opening 13A there is provided a circumscribing shoulder 14 which defines a seat for receiving a sealing washer 15 against which an orifice plate 16 seats.

As best seen in FIG. 1, the orifice plate 16 comprises an annular member having a tapering front face 16A and having an orifice opening 17 extending therethrough. Circumscringing the orifice plate, the nozzle body 11 has an integrally formed circumscribing lip 18. The circumscribing lip 18 in constructed so as to be readily deformable.

As best seen in FIG. 3 the nozzle body 13 is initially formed or fabricated with the lip 18 projecting forwardly.

In assembly, after the orifice plate 16 sealing washer 15 and valving means 19 have been positioned within the nozzle body 13, the lip 18 is staked or bent or swaged about the orifice plate 16 to fixedly secure the orifice plate in place. See FIG. 1.

The valve means 19 for valving the orifice opening 17 to regulate the spray comprises a plunger body 20 and a connected plunger stem 21. As best seen in FIGS. 1 and 2 the plunger body 20 comprises a body portion 20A which is formed with an axially extending recess 22 in the front end thereof. The plunger body 20 also includes a reduced extended end portion 20B which is adapted to extend through the rear opening 13B of the nozzle body 11. As shown, the extended end portion 20B of the plunger body 20 is externally threaded; and an adjusting nut 33 is threaded to the extended threaded end 20B.

The plunger stem 21 as viewed in FIG. 2 comprises a rod shaped member having a valve head 21A connected to one end thereof, which is adapted to be moveable relative to the orifice opening 17. The other end of the plunger stem is adapted to be press-fitted into the recess 22 of the plunger body 20.

The plunger body 20 and the plunger stem 21 are preferably formed of a metallic material which will not rust under the influence of water. It is therefore preferred that both the plunger body 20 and the plunger stem 21 be formed of brass or like material.

Intermediate the ends of the plunger stem 21 there is provided a laterally extending projection or stop 21B. In the assembled position the plunger body 20 and the connected plunger stem 21 extends axially along the head portion 11A of the nozzle body 11.

The guide means 23 is disposed between the plunger body 20 and the lateral projection 21B of the valve stem 21. As best seen in FIGS. 1 and 2, the guide means 23 comprises a member having a shank portion 23A and an enlarged connected head portion 23B. A bore 24 extends longitudinally of the guide member 23. The enlarged head portion 23B of the guide member 23 is provided with a smooth face 25 which is adapted to abutt against the sealing washer in the assembled position to form a fluid tight seal therebetween.

As best seen in FIG. 1, the outer circumference of the enlarged head portion 23B of the guide member is smaller than the internal diameter of the bore 13 of the nozzle body head portion 11A. A plurality of radially and longitudinally extending fins 26 circumscribe the headportion 23B of the guide member 23. The fins 26 thus function as a guide for valve assembly or means 19 as the valve means is moved between an operative and inoperative position. The spaces between the radial fins 26 define the fluid passages.

The rear opening 13B is sealed fluid tight by an 0 ring 27 which circumscribes the plunger body 20A. A washer 28 is disposed about the plunger body; and coil spring 29 which is disposed within the nozzle body with the ends thereof confined between the washer 28 and the head portion 23B of the guide member. The spring 29 thus functions to normally bias the valve means 19 toward a closed position.

An operating handle 30 is pivotally mounted about a pivot 31 on the neck portion 11B of the nozzle body The upper end of the handle 20 is provided with a yoke 30A which straddles the neck portion 33A of the adjusting nut 33. Accordingly, it will be noted that as the handle 30 is depressed, the yoke 30A is displaced to the left as viewed in FIG. 1. This causes the valve means or assembly to be retracted against the bias of spring 29. Depending upon the distance that the valving means 19 is retracted, the type of water spray resulting thereby is varied accordingly.

If desired, a locking member 34 may be provided for locking the handle 30 in a valve open position. As best seen in FIG. 1, the locking means comprises a U shaped bail 35 for maintaining the handle is desired open position. The opposed leg portions of the bail lock 35 are pivotally connected to the nozzle body so that in the inoperative position or valve closed position, the bail lock 35 will rest against the neck portion of the nozzle body as seen in FIG. 1. To lock the nozzle in the operative or open valve position with the handle 30 depressed, the locking bail 34 is pivoted in an upwardly direction as viewed in FIG. 1 whereby the bight or cross piece of the lock bail 34 is wedged against the yoke. Thus the bail lock 34 in the operative position functions as a stop to overcome the bias of spring 29.

In accordance with this invention, the guide means 23 is preferably formed of a plastic material. Thus as shown in FIG. 2, the shank portion 23A of the plastic guide member has an OD substantially equal to the OD of the plunger body portion and as such, will give strength and resiliency to the plunger stem 21. With this construction, relatively narrow plunger stem 21 made of relatively expensive material such as brass, can be utilized while at the same time enabling the stem 21 to maintain its strength and resiliency.

With the construction described, the guide member 23 can be made of a less expensive material, thereby requiring a minimum of relatively expensive brass material. The guide member 23 also functions as a means for accurately controlling the overall length of the valve assembly 19. In assembly in press fitting the plunger stem 21 to the plunger body 20 with the guide member 23 in place, the stop 21B on the plunger stem 21 will limit the distance that the stem will be received in recess 22. Thus the use of the guide member 23 provides an expedient and positive quality control on the overall length of the valve means.

While the present invention has been described with respect to a particular embodiment thereof, it will be readily appreciated and understood that variations and modifications may be made without departing from the spirit or scope of the invention.

What is claimed is:

1. A spray nozzle comprising:
a nozzle body,
said nozzle body having a front opening and a rear opening,
an orifice plate having a discharge orifice disposed in said front opening,
a valving means for valving said discharge orifice,
said valving means including a plunger body having an extended end portion projecting through said rear opening,
a plunger stem connected to said plunger body,
said plunger stem having a lateral projection intermediate the ends thereof,
a guide member,
said guide member having a bore extending therethrough for receiving said plunger stem,
said guide member being disposed between said lateral projection and said plunger body,
and said guide member being formed of a plastic material,
said guide member having shaft portion and an enlarged connected head portion,
said head portion having projecting fins disposed in relative sliding relationship to the internal bore of said nozzle body,
a spring disposed about said plunger stem,
and means for actuating said valving means.

2. The invention as defined in claim 1 wherein said shaft portion of said guide member defines an extension of said plunger body.

3. The invention as defined in claim 1 wherein said plunger stem is press fitted to a recess formed in said plunger body.

4. The invention as defined in claim 3 wherein said guide member limits the extent said plunger stem is recessed in said plunger body.

5. The invention as defined in claim 1 and including means circumscribing said front opening for fixedly securing said orifice plate to said nozzle body.

6. The invention as defined in claim 1 wherein said actuating means comprises:
a handle pivoted to said nozzle body,
said handle having a yoke at one end for straddling the extended end portion of said plunger body,
and an adjusting means connected to said extended end portion for retaining said yoke operatively connected to said plunger body whereby actuation of said handle effects a corresponding movement of said plunger stem and associated guide.

7. The invention as defined in claim 1 and including sealing means for sealing said front opening and rear opening fluid tight.

8. A spray nozzle comprising:
a nozzle body,
said nozzle body having a front opening and a rear opening,
and orifice plate having a discharge orifice disposed in said front opening,
a valving means for valving said discharge orifice,
said valving means including a plunger body having an extended end portion projecting through said rear opening,
a plunger stem connected to said plunger body,
said plunger stem having a lateral projection intermediate the ends thereof,
a guide member,
said guide member having a bore extending therethrough for receiving said plunger stem,
said guide member being disposed between said lateral projection and said plunger body,
a spring disposed about said plunger stem,
means for actuating said valve means,
and means circumscribing the front opening for fixedly securing said orifice plate in said nozzle body,
wherein said circumscribing means comprises a deformable lip formed integrally with said nozzle body whereby said lip is press fitted to fixedly secure said orifice plate in position within said front opening.

9. A spray nozzle comprising:
a nozzle body having a front opening and an axially aligned rear opening,
an orifice plate having a discharge orifice disposed in said front opening,
means formed integrally with said nozzle body circumscribing said orifice plate for retaining said orifice plate fixedly secured to said nozzle body,
said circumscribing means comprising a deformable lip formed integrally with said nozzle body whereby said lip is press fitted to fixedly secure said orifice plate in position with said opening,
a valve means for valving said discharge orifice,
said valve means including plunger body having an extended portion projecting through said rear opening,
a plunger stem connected to said plunger body; said stem having a lateral projection intermediate the ends thereof,
said plunger stem extending in axially alignment with said orifice,
and a guide disposed between said plunger body and said lateral projection,
said guide being formed of a plastic material.

10. A water spray nozzle comprising:
a nozzle body having a head portion and a stem portion,
said stem portion having a thread nipple for receiving the threaded end of a hose,
said head portion having a bore extending therethrough which terminates in a front opening and a rear opening,
said front opening having an in-turned flange defining a seat,
an orifice plate having an orifice therein,
a sealing washer disposed between said plate and said seal to define a water tight seal about said front opening,
a lip circumscribing said orifice plate,
said lip being integrally formed with said head portion of said nozzle body,
said lip being readily deformable for securing said orifice plate within said front opening,
a valving means including a plunger body having a threaded extension,
said threaded extension projecting through said rear opening,
a plunger stem connected to said plunger body,
said plunger stem having a valve head connected to the extended end thereof,
and a lateral projection intermediate the ends thereof,
a guide member,
saod guide member having a shank portion and an enlarged head portion,
said guide member being disposed between said plunger body and said lateral projection,
radial fins connected to said head portion of said guide member,
a fluid tight seal sealing said rear opening,
a spring means disposed about said plunger stem and associated guide member,
a handle pivotally connected to said stem portion,
said handle having a yoke for straddling the extended threaded end of said plunger body.
and an adjusting nut for retaining said yoke operatively connected to said threaded extension of said plunger body.

* * * * *